US008211001B2

(12) United States Patent
Moulin

(10) Patent No.: US 8,211,001 B2
(45) Date of Patent: Jul. 3, 2012

(54) DEVICE FOR APPLYING RUNNERS ON CLOSURE PROFILES

(75) Inventor: Isabelle Moulin, Paris (FR)

(73) Assignee: S2F Flexico, Henonville (FR)

( * ) Notice: Subject to any disclaimer, the term of this patent is extended or adjusted under 35 U.S.C. 154(b) by 265 days.

(21) Appl. No.: 12/522,697

(22) PCT Filed: Jan. 9, 2008

(86) PCT No.: PCT/EP2008/050159
§ 371 (c)(1),
(2), (4) Date: Jul. 9, 2009

(87) PCT Pub. No.: WO2008/084052
PCT Pub. Date: Jul. 17, 2008

(65) Prior Publication Data

US 2010/0105535 A1 Apr. 29, 2010

(30) Foreign Application Priority Data

Jan. 10, 2007 (FR) ..... 07 52619

(51) Int. Cl.
*B31B 1/84* (2006.01)

(52) U.S. Cl. ..... 493/213; 493/394; 493/114

(58) Field of Classification Search ..... 493/213, 493/394, 114, 927, 309; 53/133.4, 139.2
See application file for complete search history.

(56) References Cited

U.S. PATENT DOCUMENTS

| | | | | |
|---|---|---|---|---|
| 2,879,588 | A * | 3/1959 | Morin | 29/408 |
| 6,161,271 | A * | 12/2000 | Schreiter | 29/408 |
| 6,199,256 | B1 * | 3/2001 | Revnew et al. | 29/408 |
| 6,517,473 | B1 * | 2/2003 | Cappel | 493/213 |
| 6,526,726 | B1 * | 3/2003 | Strand et al. | 53/412 |
| 6,804,935 | B2 * | 10/2004 | Schneider et al. | 53/412 |
| 7,244,222 | B2 * | 7/2007 | Woody et al. | 493/213 |
| 7,341,085 | B2 * | 3/2008 | Tinivella | 156/513 |
| 7,472,524 | B2 * | 1/2009 | Hoffman et al. | 53/410 |
| 7,563,219 | B2 * | 7/2009 | Owen et al. | 493/213 |
| 2005/0197240 | A1 | 9/2005 | Woody et al. | |

FOREIGN PATENT DOCUMENTS

| | | |
|---|---|---|
| EP | 0 025 148 A1 | 3/1981 |
| FR | 2 076 728 A | 10/1971 |

* cited by examiner

*Primary Examiner* — Sameh H. Tawfik
(74) *Attorney, Agent, or Firm* — Blakely, Sokoloff, Taylor & Zafman

(57) ABSTRACT

The present invention relates to a device for applying runners (32) on closure profiles (22), comprising various actuator means (110, 120, 130, 140) driven by a common driving means (150), including a wheel (110) for driving a chain of runners (32) temporarily linked together by breakable bridges (34) in order to transfer successively each runner (32) towards an application station on the closure profiles (22); characterized in that the device includes means (170) for manually disengaging the driving wheel (110) relative to the other actuator members (120, 130, 140). The invention also relates to a method and a machine implementing the above-mentioned runner application device, and to the closure profiles and bags thus obtained.

8 Claims, 6 Drawing Sheets

DEVICE FOR APPLYING RUNNERS ON CLOSURE PROFILES

This is a non-provisional application claiming the benefit of International application number PCT/EP2008/050159 filed Jan. 9, 2008.

BACKGROUND OF THE INVENTION

1. Field of the Invention

The present invention concerns the area of closure profiles for bags equipped with sliders.

Numerous closure profiles equipped with sliders have already been proposed.

One of the problems raised in this area relates to the engaging of the sliders on the profiles.

2. Description of Related Art

Document U.S. Pat. No. 6,490,769 gives an example of known sliders. The present invention applies in particular to use of the slider described in this document. However the invention is not limited to this particular slider.

Different devices have also been proposed intended to ensure the engaging of sliders on closure profiles.

Examples of known devices can be found in documents FR 2076345 and FR 2076728.

BRIEF SUMMARY OF THE INVENTION

The purpose of the present invention is to propose novel means designed to ensure the application of sliders onto a closure profile, having superior properties to those of the prior art.

This purpose is achieved under the invention by means of a device to apply sliders onto closure profiles, comprising different actuator elements driven by a common motor means including a driving wheel driving a chain of sliders provisionally joined together by scored links so as successively to transfer each slider towards a station where it is applied to the closure profile, characterized by the fact that the device comprises manual disengaging means for the driving wheel with respect to the other actuator elements.

The invention also relates to a method and machine using the abovementioned slider application device and to the closure profiles and bags equipped therewith.

BRIEF DESCRIPTION OF THE DRAWINGS

Other characteristics, purposes and advantages of the present invention will become apparent on reading the following detailed description with reference to the appended drawings given as non-limiting examples in which.

DETAILED DESCRIPTION OF THE INVENTION

Figure 1:
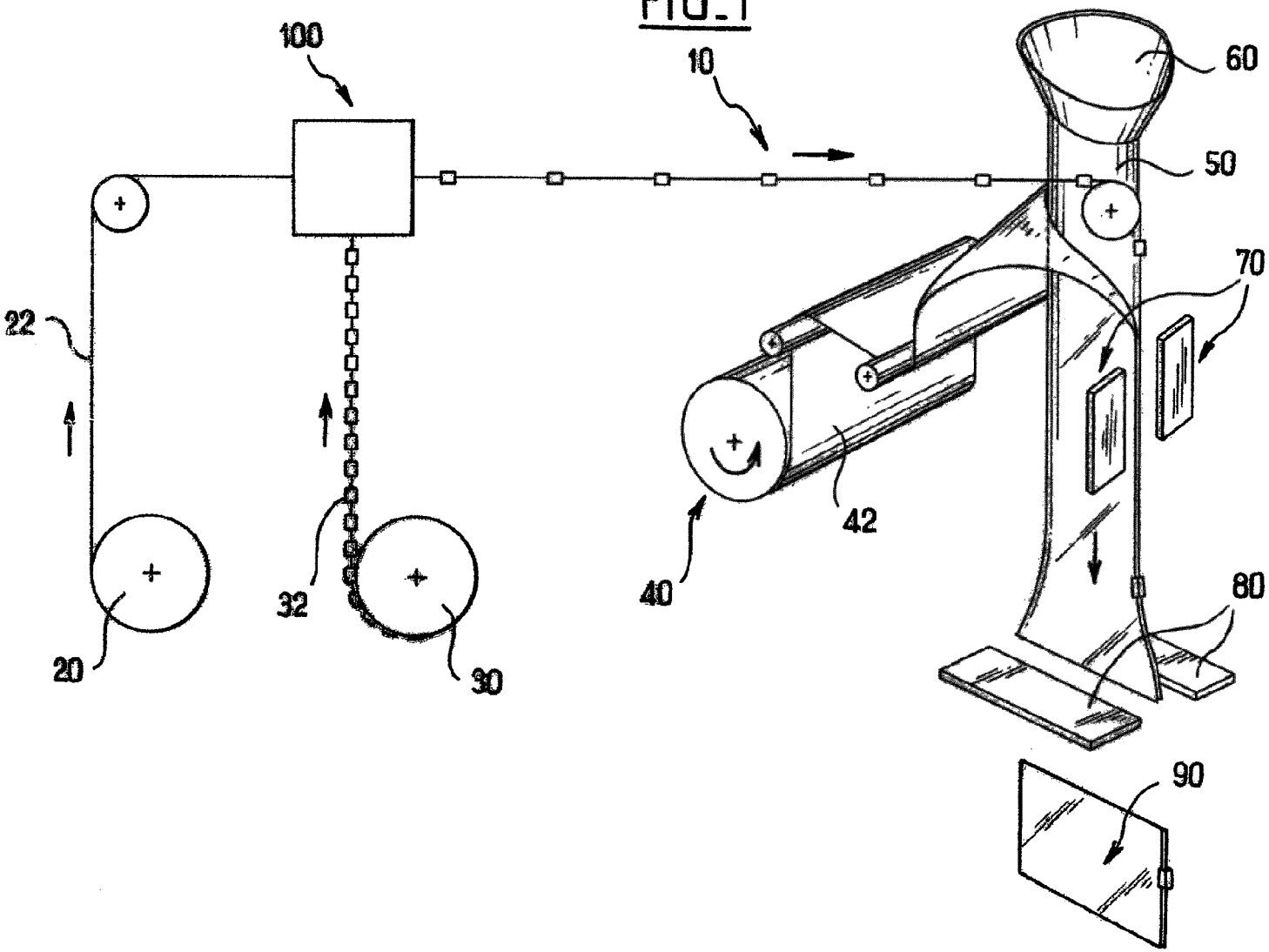
FIG. 1 is a schematic perspective view of a machine to manufacture bags able to be equipped with a slider application device conforming to the invention.
Figure 2:
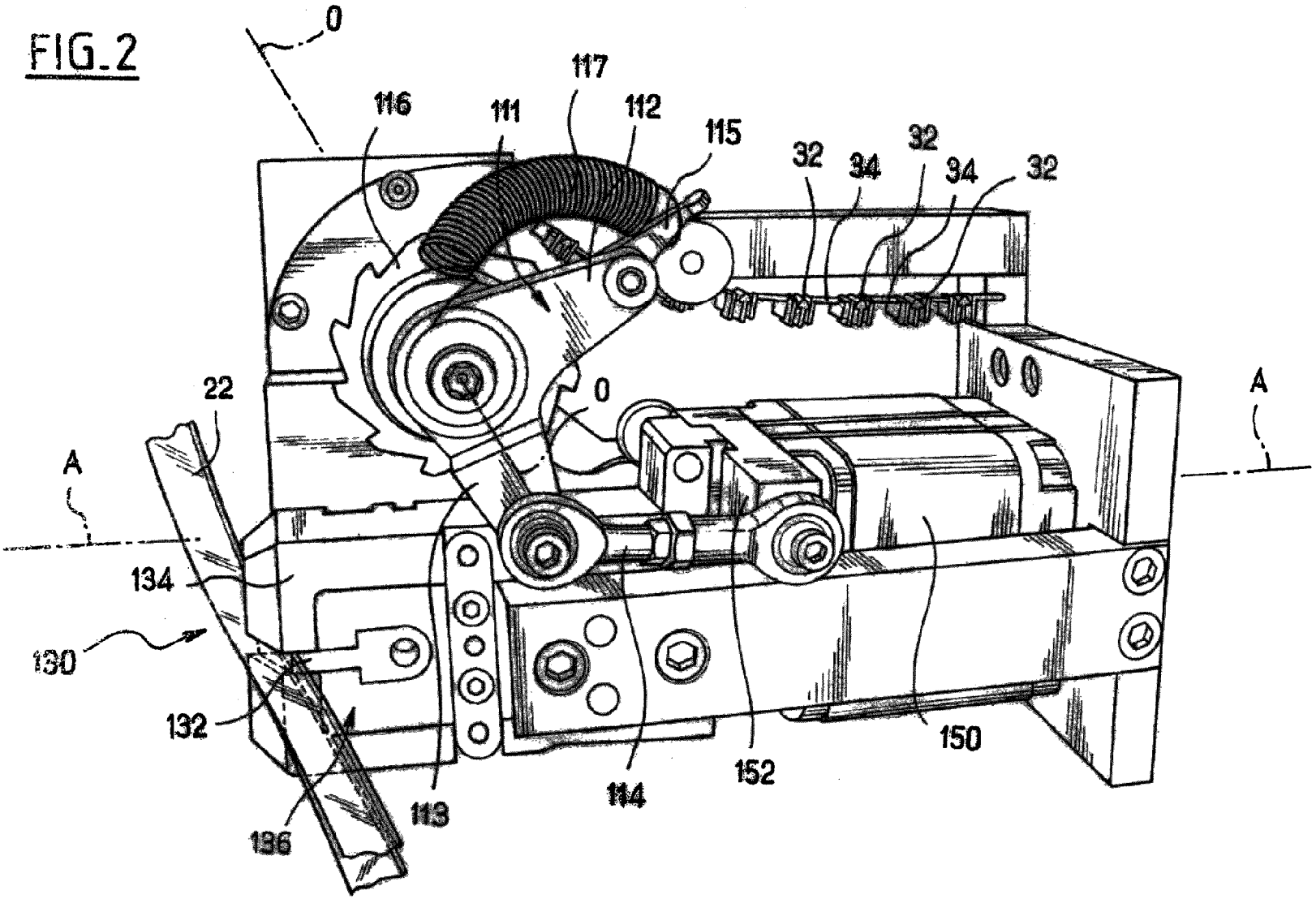
FIGS. 2 and 3 are perspective views of the slider application device conforming to the present invention.
Figure 3:
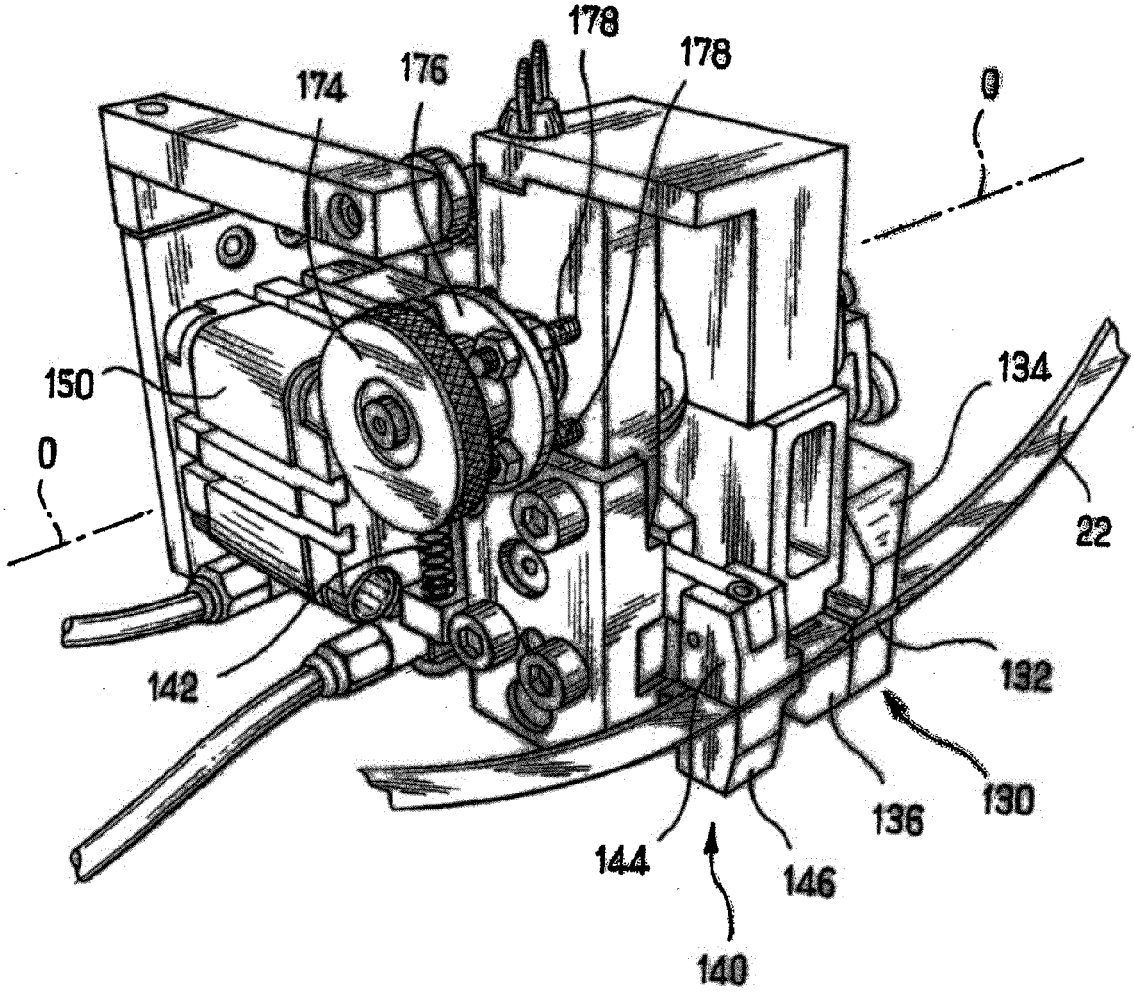
Figure 4:
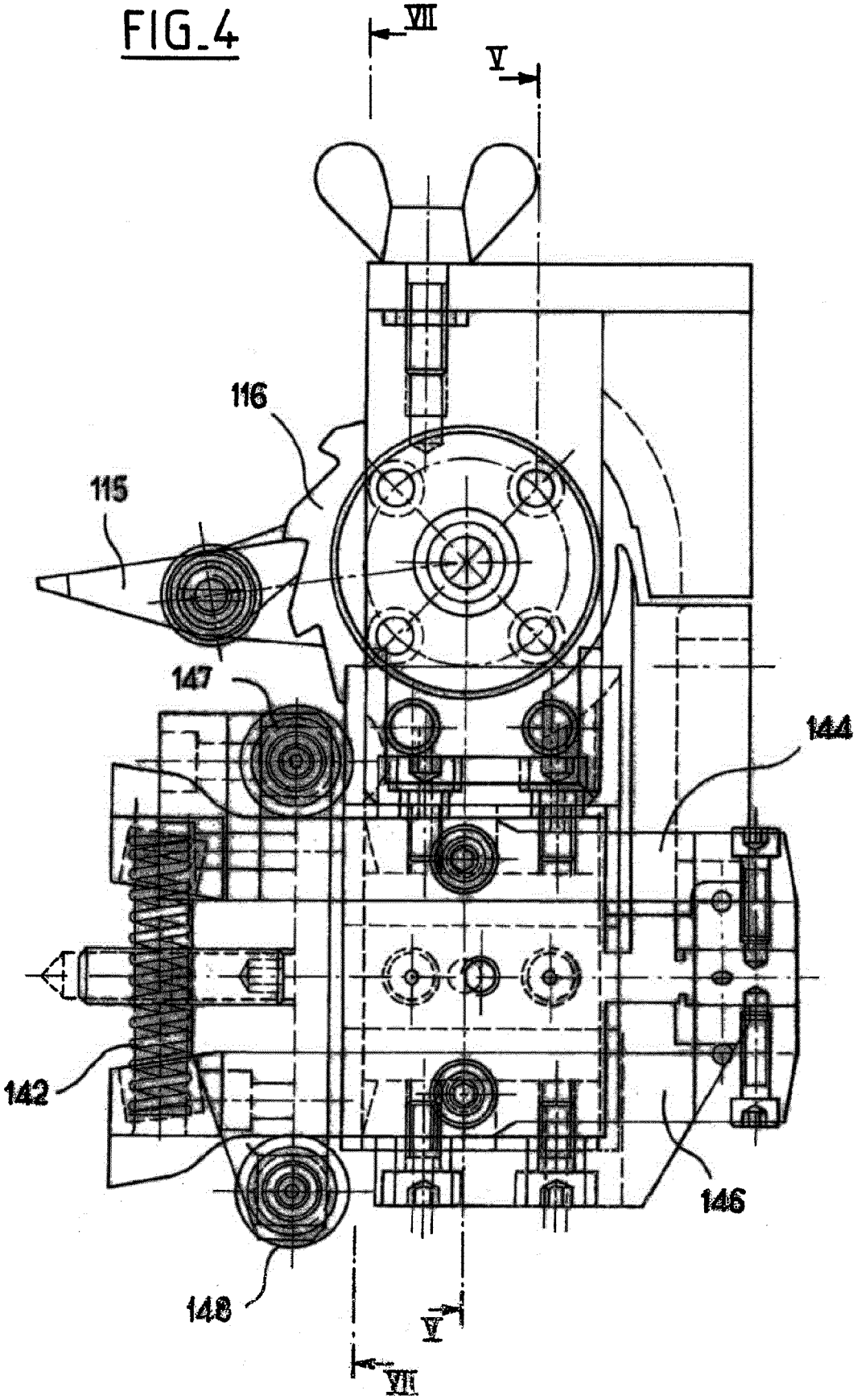
FIG. 4 is a partial cutaway side view of the slider application device conforming to the present invention.
Figure 5:
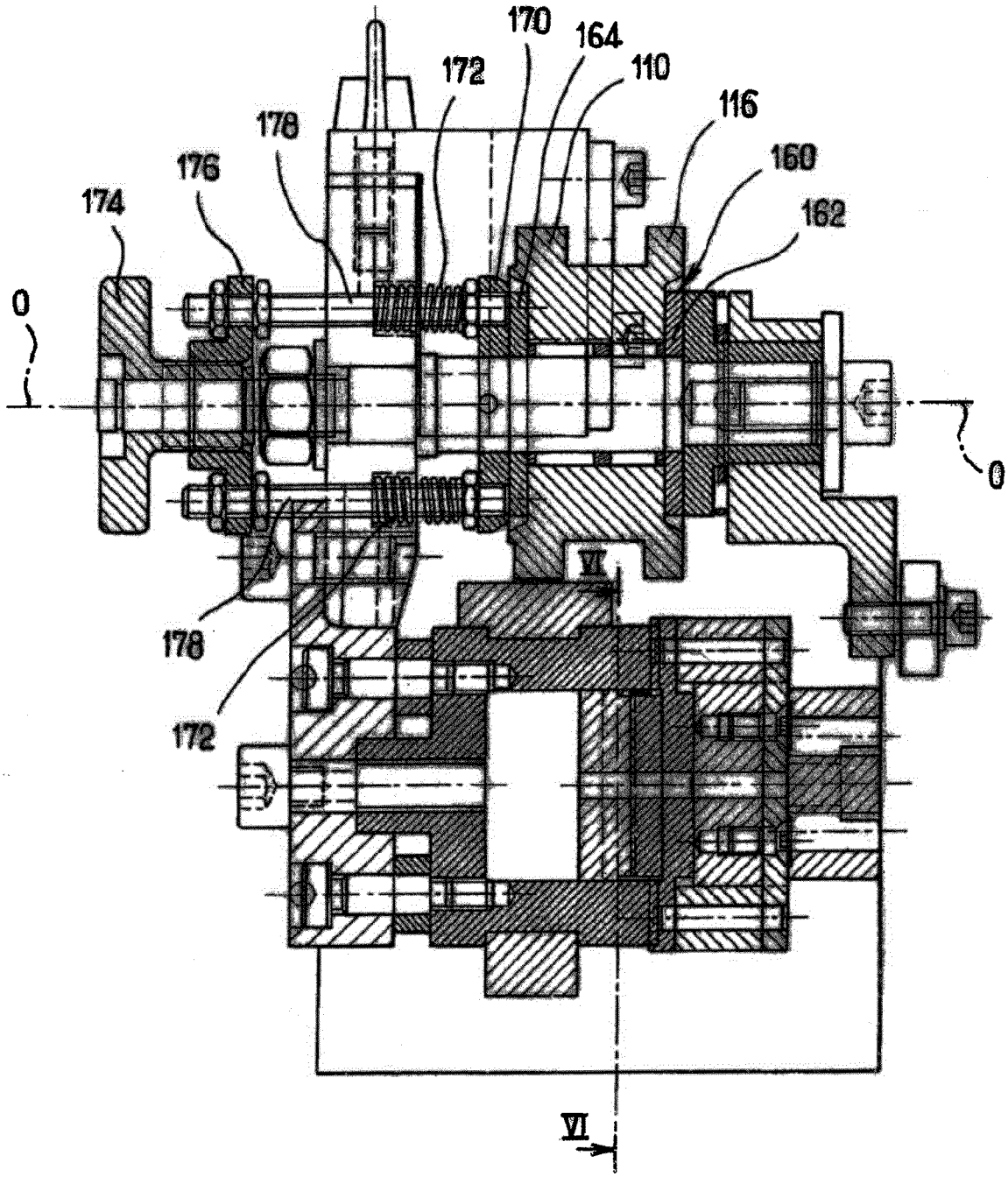
FIG. 5 is a cross-sectional view of the device along the section plane referenced V-V in FIG. 4, and FIGS. 6 and 7 are cross-sectional views of the same device along the section planes referenced VI-VI in FIG. 5 and VII-VII in FIG. 4.
Figure 6:
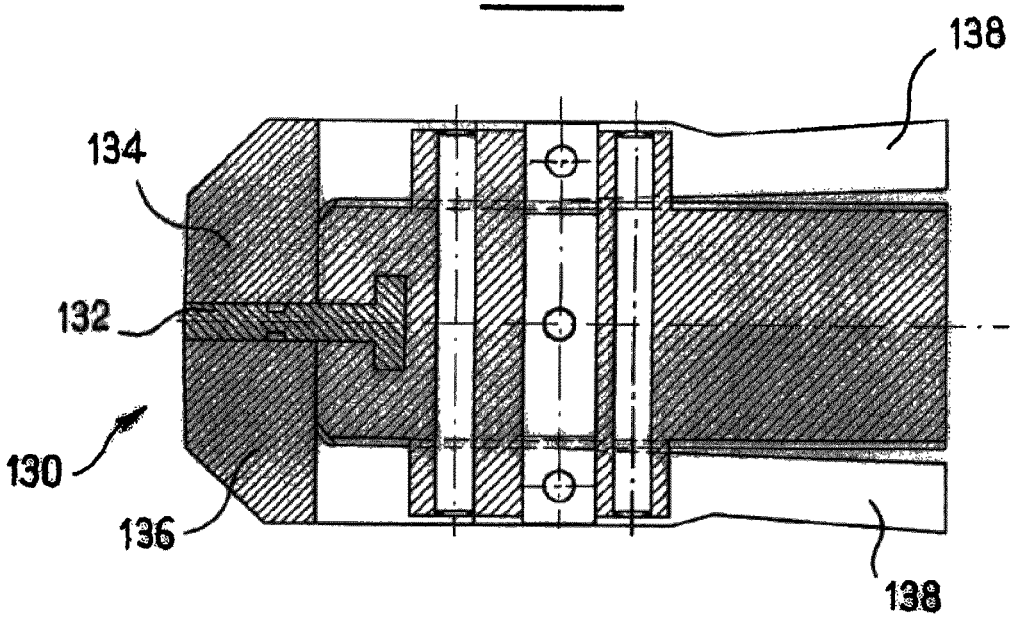

The invention applies in particular to the manufacturing of bags on an automatic machine of form-fill-seal type schematically illustrated in appended FIG. 1.

Said machine 10 comprises:

means 20 supplying a strip 22 of closure profiles, means 30 supplying chains 32 of sliders, a station 100 described in more detail below in the present invention intended to carry out sequential, individual application of each slider 32 onto the strip 22, means 40 supplying a thermoplastic film 42, a forming neck 50 associated with a filling chute 60 which conforms the film 42 from an initial planar state to a tube, means 70 ensuring longitudinal welding of the adjacent longitudinal edges of the film 42 and fixing of the closure strip 22 equipped with sliders 32 onto the film 42, and transverse welding jaws 80 associated with cutting means 80 to separate the bags individually.

Said bag is schematically illustrated under reference 90 in FIG. 1.

The general structure of the machine illustrated FIG. 1 is known to persons skilled in the art and will therefore not be described in further detail.

Also, appended FIG. 1 shows a machine in which the closure strip 22 equipped with sliders 32 is applied longitudinally to the edges of the film 42 i.e. parallel to the direction of travel of the film 42. As a variant the closure strip 22 equipped with sliders 32 can be applied crosswise onto the film 42 i.e. at least substantially perpendicular to the direction of travel of the film 42.

According to other variants, the slider application device 100 conforming to the present invention can be used on any automatic packaging machine and on welding machines for the manufacturing of empty bags.

Additionally, according to the illustrated given FIG. 1, the slider application device 100 is designed to apply sliders 32 to the strip 22 of closure profiles before welding of the strip 22 onto the film. As a variant, however, the application device 100 according to the present invention can also be used to apply sliders 32 to the closure strip 22 after welding the closure strip 22 onto the film 42, irrespective of the type of film conformation machine 42 that is used.

The application device 100 conforming to the present invention can also be used to pre-position sliders 32 on closure profile strips 22 at a fixed point, and to fix the closure strips thus equipped with sliders 32 onto a film during a subsequent, separate step and optionally on a different site.

The present invention applies to any type of closure strip 22 in particular closure strips comprising mating male and female profiles, hook profiles, profiles joined together by a U-shaped connection strip or equivalent to form an opening indicator, etc. . . .

The closure device 100, conforming to the present invention and shown in the appended figures, comprises four actuator elements: a driving wheel 110, a pusher 120, a spacer 130 and a clamp 140. These four actuator elements are driven by a common motor element 150 preferably consisting of a pneumatic jack 150 more precisely by a rod-and-valve assembly 152 joined to the jack piston 150 and driven on command in an alternate translation movement centered on axis A-A.

The general structure of these four actuator elements is known from the above-cited documents FR-A-2076728 and FR-A-2076345. It will therefore not be described in further detail in the remainder hereof.

It is recalled however:

that the spacer 130 preferably comprises a fixed central insert 132 intended to be engaged between two profiles of the closure strip 22 for their separation, and two jaws 134, 136 surrounding the insert 132 and preferably driven alternately between a clamped position in which the jaws 134, 136 clamp support webs of the above-mentioned profiles against the outer surfaces of the insert 32 when the travel movement of the strips 22 is temporarily stopped for application of a slider 32, and a drawn-apart position allowing travel of the closure strip 22. The driving of the jaws 134, 136 between the two above-described positions by the motor 150 can have numerous configurations. Preferably, the jaws 134, 136 are drawn together by elastic means 131 and are drawn apart by a set of rollers 137 carried by the rod-and-valve assembly 152 and cooperating with cams 138 joined to the jaws 134, 136.

that the clamp 140 positioned downstream of the spacer 130 relative to the direction of travel of the strip 22, preferably comprises two jaws 144, 146, driven alternately between a clamped position in which the jaws 144, 146 clamp the support webs of the above-mentioned profiles during temporary stoppage of the travel movement of the strips 22 for application of a slider 32, and a drawn-apart position allowing travel movement of the closure strip 22. The driving of the jaws 144, 146 between the two above-described positions by the motor 150 can also have numerous configurations. Preferably, the jaws 144, 146 are drawn together by elastic means 142 and are drawn apart by a set of rollers 147 carried by the rod-and-valve assembly 152 and cooperating with cams 148 joined to the jaws 144, 146, that the driving wheel 110 is driven in rotation by means which will be detailed below, about an axis O-O parallel to the direction of travel of the strip 22, to convey the sliders 32 joined together in a chain by scored links 34 successively towards an application station positioned between the spacer 130 and the clamp 140, that the pusher 120 joined to the rod-and-valve assembly 152 is moved alternately in translation along axis A-A to push a slider 32, placed opposite, onto the strip 22 (whose two profiles have been drawn apart upstream by the spacer 130) and to separate the slider 32 from the scored links 34 provisionally joining the sliders together (preferably by cutting these links 34 against an anvil provided at this station).

The chains of sliders 32 used preferably conform to those in document FR-A-2076728 with respect to their general structure. They will not therefore not be described in further detail in the remainder hereof.

Figure 7:
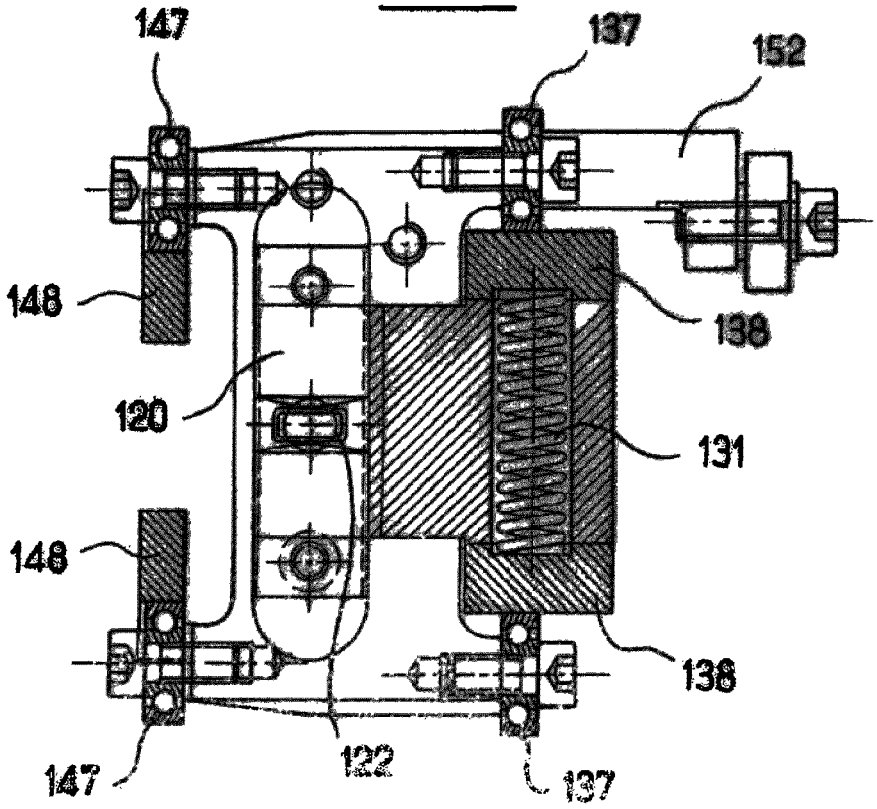

However, preferably, each slider 32 in this chain conforms to document U.S. Pat. No. 6,490,769 in that at its top part it comprises two wings adapted to be acted upon by a tappet 122 (see FIG. 7) provided at the end of the pusher 120 so as to draw apart the side walls of the slider before it is applied to the strip 22 as described in document U.S. Pat. No. 6,490,769.

The driving wheel 110 can have numerous configurations. On its periphery it comprises a series of teeth or bearers adapted successively to take in charge the sliders and to transfer them to the application station positioned between the spacer 130 and the clamp 140.

The means to drive the wheel 110 in rotation by the rod-and-valve assembly 152 can be in the form of numerous embodiments.

In their general structure they preferably conform to the means defined in document FR-A-2076728.

More precisely, as can be seen in the appended figures, these means preferably comprise a lever 111 with two arms 112, 113 mounted in rotation about axis O-O. One of the arms 113 is connected to the rod-and-valve assembly 152 via a bar or connecting rod 114. The second arm 112 carries a pawl 115 having angular clearance relative to the arm 112 and cooperating with a cogwheel 116 joined to the driving wheel 110.

The pawl 115 can be associated with a return spring 117.

As described in FR-A-2076728 in one direction of travel of the rod-and-valve assembly 152, the pawl 115 drives wheel 116 and hence wheel 110 over an angular pitch. In the other direction of travel of the rod-and-valve assembly 152, the pawl 115 pivots relative to the arm 112 to move away and reach the adjacent tooth of the cogwheel 115 before repeating a new driving operation of wheel 116.

Wheel 110 and associated wheel 116 are braked by a friction brake 160 to prevent the wheel 110 from rotating in an opposite direction to that resulting from action of the lever 111 and pawl 115. The friction brake according to the invention is formed of two friction washers or linings 162, 164 respectively arranged either side of the wheel 110. More precisely, the two friction linings 162, 164 and the wheel 110 sandwiched therebetween are clamped between a frame of the device on one side and a disengageable actuator element 170 on the other side.

According to the embodiment shown in the appended figures, this element 170 is formed of a ring bearing upon the outer surface of the lining 164 and drawn into a clamping position by a set of tared springs 172.

The ring 170 can however be drawn away from the wheel 110 so as to disengage the lining 164 and the wheel 110 by means of a system of screw/nut type. Numerous variants of embodiment thereof are possible. It will therefore not be described in further detail in the remainder hereof.

However, preferably, this screw/nut system comprises a threaded screw wheel 174 cooperating with a plate 176 carrying a set of tie rods 178 connected to the ring 170 (and on which the springs 172 for example are positioned) so that rotation of the screw wheel 174 via the plate 176 and the ties 178 ensures a pulling force on the ring 170 ensuring disengagement of the wheel 110.

The general functioning of the device 100 conforming to the present invention remains identical to that known from and described in document FR-A-2076728 in particular.

However, the new possibility of disengaging the wheel 110 makes it possible, at the time of initial installation of a chain of sliders 32 or even during a maintenance operation, to disengage the wheel 110 with respect to the other actuator elements 120, 130, 140 and thereby ensure provisional free rotation of the wheel 110, for example to engage or disengage a chain of sliders 32.

Thereafter, the indispensable precise re-synchronization of the driving wheel 110 with the actuator elements 120, 130, 140 (this precise synchronization being mandatory since the sliders must be successively positioned with great precision relative to the pusher 120 during movement thereof) is ensured by simply placing the cogwheel 116 in abutment against the pawl 115 when tightening the screw wheel 174 to ensure engaging.

Evidently, the present invention is not limited to the particular embodiments just described but extends to any variant conforming to the spirit thereof.

The invention claimed is:

1. Device to apply sliders (32) onto closure profiles (22) comprising different actuator elements (110, 120, 130, 140) driven by common motor means (150), said different actuator elements including a spacer (130) comprising:

a central insert (132) engageable between two profiles of a closure strip and two jaws (134, 136) surrounding the insert (132) and driven alternatively between a clamped position in which the jaws (134, 136) clamp support webs of the two profiles against outer surfaces of the insert and a drawn-apart position;

a clamp (140) comprising two jaws (144, 146) driven alternatively between a clamped position in which the jaws (144, 146) clamp the support webs of the profiles and a drawn-apart position;

a pusher (120) moved alternative in translation to push a slider onto said closure strip profiles, and a driving wheel (110) driving a chain of sliders (32) provisionally joined together by scored links (34) so as successively to transfer each slider (32) towards a station for their application to the closure profiles (22), by said pusher (120), said driving wheel being driven in rotation about an axis parallel to the direction of travel of the closure profiles, a friction brake (160) acting on said driving wheel (110), said friction brake comprising two friction washers respectively arranged either side of said driving wheel (110) and urged towards said driving wheel (110) by at least one spring (172) wherein;

the device further comprises a screw/nut system (174, 176) adapted to act upon a lining of the friction brake so as to form disengaging means (170) allowing by actuation of said screw/nut system to disengage said lining from said driving wheel (110) and consequently for disengaging the driving wheel (110) with respect to the spacer (130), the clamp (140) and the pusher (120).

2. Device according to claim 1, characterized by the fact that the driving wheel (110) is joined to a cogwheel (116) and the device comprises a driving lever (112) equipped with a pawl (115) cooperating with the cogwheel (116).

3. Device according to claim 1, wherein the common mater means (150) is a pneumatic jack comprising a piston driven in alternate translation.

4. Device according to claim 1, wherein the two jaws (134, 136) of the spacer are drawn in the clamped position by elastic means and said two jaws are drawn apart by a set of rollers (137) actuated by said common motor means (150) and cooperating with cams (138) joined to the jaws (134, 136).

5. Device according to claim 1, wherein the two jaws (144, 146) of the clamp are drawn in the clamped position by elastic means and said two jaws are drawn apart by a set of rollers (147) actuated by said common motor means (150) and cooperating with cams (148) joined to the jaws (144, 146).

6. Device according to claim 3, wherein the pusher (120) is connected to the piston.

7. Device according to claim 1, wherein the common motor means (150) comprises a piston (150) driven in alternate translation and the driving wheel (110) is joined to a cogwheel (116) associated with a driving lever having two arms, one arm being connected to said piston while the other arm carries a pawl cooperating with the cogwheel (116).

8. Device according to claim 1, wherein the screw/nut system comprises a ring (170) bearing upon an outer surface of a lining of said friction brake, said ring (170) carrying a set of tie rods (178) connected to a plate (176) of the screw/nut system so that acuation of the screw/nut system ensures a pulling force on the ring (170) ensuring disengagement of the driving wheel (120).

* * * * *

UNITED STATES PATENT AND TRADEMARK OFFICE

CERTIFICATE OF CORRECTION

PATENT NO. : 8,211,001 B2
APPLICATION NO. : 12/522697
DATED : July 3, 2012
INVENTOR(S) : Isabelle Moulin It is certified that error appears in the above-identified patent and that said Letters Patent is hereby corrected as shown below:

In the Claims, Column 5, Claim 1, Line 7, delete "alternative" and insert -- alternatively --.

Signed and Sealed this
Eighteenth Day of September, 2012

David J. Kappos

David J. Kappos
*Director of the United States Patent and Trademark Office*